US011313187B2

(12) United States Patent
Al-Malki et al.

(10) Patent No.: US 11,313,187 B2
(45) Date of Patent: Apr. 26, 2022

(54) LOSS CIRCULATION TREATMENT FLUID INJECTION INTO WELLS

(71) Applicant: Saudi Arabian Oil Company, Dhahran (SA)

(72) Inventors: Bander S Al-Malki, Dammam (SA); Yousef H. Dahnem, Qatif (SA); Ismail Adebiyi, Dhahran (SA); Asim Alkhuwayr, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/988,399

(22) Filed: Aug. 7, 2020

(65) Prior Publication Data

US 2022/0042383 A1 Feb. 10, 2022

(51) Int. Cl.

| | |
|---|---|
| ***E21B 33/12*** | (2006.01) |
| ***E21B 21/00*** | (2006.01) |
| ***E21B 29/00*** | (2006.01) |
| ***E21B 33/14*** | (2006.01) |

(52) U.S. Cl.

CPC ..... *E21B 21/003* (2013.01); *E21B 29/00* (2013.01); *E21B 33/12* (2013.01); *E21B 33/14* (2013.01)

(58) Field of Classification Search

CPC ..... E21B 23/04

See application file for complete search history.

(56) References Cited

U.S. PATENT DOCUMENTS

| | | | | |
|---|---|---|---|---|
| 4,031,957 | A * | 6/1977 | Sanford | E21B 21/10 166/264 |
| 4,287,949 | A * | 9/1981 | Lindsey, Jr. | E21B 43/10 166/208 |
| 5,628,366 | A | 5/1997 | Telfer | |
| 7,086,475 | B2 | 8/2006 | Cook | |
| 8,453,724 | B2 | 6/2013 | Zhou | |
| 2012/0073828 | A1 * | 3/2012 | Churchill | E21B 34/06 166/373 |
| 2013/0068481 | A1 | 3/2013 | Zhou | |
| 2018/0187492 | A1 | 7/2018 | Amri et al. | |
| 2018/0274312 | A1 | 9/2018 | Zhou | |
| 2019/0257162 | A1 | 8/2019 | Zhou | |

OTHER PUBLICATIONS

PCT International Search Report and Written Opinion in International Appln. No. PCT/US2021/044842, dated Oct. 25, 2021, 13 pages.

* cited by examiner

*Primary Examiner* — William D Hutton, Jr.

*Assistant Examiner* — Avi T Skaist

(74) *Attorney, Agent, or Firm* — Fish & Richardson P.C.

(57) ABSTRACT

A protective tubular is run downhole into a wellbore in a subterranean formation. A non-metallic tubular is disposed within the protective tubular. The non-metallic tubular includes an adapter. The adapter includes a spring-loaded latch, a ball seat, a shear pin, and a ball catcher. While intact, the shear pin holds a position of the non-metallic tubular relative to the protective tubular. A ball is used to shear the shear pin of the adapter, thereby allowing the non-metallic tubular to move relative to the protective tubular. Pressure is applied to the ball to move the non-metallic tubular relative to the protective tubular. The non-metallic tubular is coupled to the protective tubular using the spring-loaded latch of the adapter. Pressure is applied to the ball to shear the ball seat of the adapter. A fluid is flowed into the non-metallic tubular through an opening defined by the adapter.

13 Claims, 5 Drawing Sheets

LOSS CIRCULATION TREATMENT FLUID INJECTION INTO WELLS

TECHNICAL FIELD

This disclosure relates to fluid injection into wells, and in particular, loss circulation treatment fluid injection into wells.

BACKGROUND

In oil or gas well drilling, lost circulation is an undesirable situation in which drilling fluid, also known as mud, flows into a subterranean formation instead of returning up to the surface. In partial lost circulation, mud continues to flow to the surface with some loss of mud to the formation. In total lost circulation, all of the mud flows into the formation with no return to the surface. The consequences of lost circulation can range from a loss of drilling fluid to blowout or even loss of life. Prevention of lost circulation is desirable, but because lost circulation is such a common occurrence, remediation methods can help mitigate lost circulation when it has occurred.

SUMMARY

This disclosure describes a dual tubular device that can be used to flow lost circulation treatment fluid into a wellbore. The subject matter described in this disclosure can be implemented in particular implementations, so as to realize one or more of the following advantages. First, the use of an outer, protective tubular surrounding the inner, non-metallic tubular mitigates or prevents fracturing of the inner tubular while the apparatus is being run downhole, for example, due to slack off. Second, the use of the outer, protective tubular also allows for the deployment process (that is, running the apparatus downhole) to proceed independent of tripping speed limitations. Third, due to the nature of the inner tubular being made of a material that can be drilled without requiring more force than typical for drilling through cement, the clean out process after using the apparatus does not incur additional time or cost to carry out.

Certain aspects of the subject matter described can be implemented as a method. A protective tubular is run downhole into a wellbore in a subterranean formation. A non-metallic tubular is disposed within the protective tubular. The non-metallic tubular includes an adapter at an uphole end of the non-metallic tubular. The adapter includes a spring-loaded latch, a ball seat, a shear pin, and a ball catcher. The shear pin holds a longitudinal position of the non-metallic tubular relative to the protective tubular while the shear pin is intact. A ball is flowed to the ball seat of the adapter, thereby shearing the shear pin of the adapter and allowing the non-metallic tubular to move longitudinally relative to the protective tubular. Pressure is applied to the ball to move the non-metallic tubular longitudinally relative to the protective tubular until an uphole end of the non-metallic tubular meets a downhole end of the protective tubular. The uphole end of the non-metallic tubular is coupled to the downhole end of the protective tubular using the spring-loaded latch of the adapter. Pressure is applied to the ball to shear the ball seat of the adapter, thereby allowing the ball to pass through the sheared ball seat and be received by the ball catcher of the adapter. A fluid is flowed into the non-metallic tubular through an opening defined by the adapter between the ball seat and the ball catcher.

In some implementations, running the protective tubular downhole into the wellbore includes running a drill pipe downhole into the wellbore with the protective tubular disposed at a downhole end of the drill pipe.

In some implementations, the non-metallic tubular includes at least one of plastic, rubber, or ceramic. In some implementations, the protective tubular includes a metal.

In some implementations, the fluid is a lost circulation treatment fluid that includes bridging material, rapid-setting cement, thixotropic cement, lightweight cement, or a combination of these.

In some implementations, the fluid is allowed to set within the wellbore. In some implementations, the non-metallic tubular is drilled after the fluid has set.

In some implementations, the protective tubular and the non-metallic tubular are retrieved from the wellbore. In some implementations, the non-metallic tubular is re-disposed within the protective tubular. In some implementations, the protective tubular is run downhole into a second wellbore, for example, in the subterranean formation.

Certain aspects of the subject matter described can be implemented as a method. A drill pipe is run downhole into a wellbore in a subterranean formation. A non-metallic tubular is run downhole through the drill pipe. The non-metallic tubular includes an adapter at an uphole end of the non-metallic tubular. The adapter includes a spring-loaded latch. At least a portion of the non-metallic tubular is exposed from a downhole end of the drill pipe. The uphole end of the non-metallic tubular is coupled to the downhole end of the drill pipe using the spring-loaded latch of the adapter. A fluid is flowed within the non-metallic tubular to the subterranean formation through an opening defined by the non-metallic tubular.

In some implementations, the downhole end of the drill pipe includes a hanging sub. In some implementations, coupling the uphole end of the non-metallic tubular to the downhole end of the drill pipe includes coupling the uphole end of the non-metallic tubular to the hanging sub of the drill pipe using the spring-loaded latch of the adapter.

In some implementations, running the non-metallic tubular downhole through the drill pipe includes running the non-metallic tubular downhole through the drill pipe using a slick line.

In some implementations, the slick line is over pulled to release the slick line from the adapter of the non-metallic tubular before flowing the fluid.

In some implementations, the fluid is a lost circulation treatment fluid that includes bridging material, rapid-setting cement, thixotropic cement, lightweight cement, or a combination of these.

In some implementations, the fluid is allowed to set within the wellbore. In some implementations, the non-metallic tubular is drilled after the fluid has set.

In some implementations, the drill pipe and the non-metallic tubular are retrieved from the wellbore. In some implementations, the drill pipe is run downhole into a second wellbore, for example, in the subterranean formation. In some implementations, the non-metallic tubular is run downhole through the drill pipe within the second wellbore. In some implementations, at least a portion of the non-metallic tubular is exposed from the downhole end of the drill pipe within the second wellbore. In some implementations, the uphole end of the non-metallic tubular is coupled to the downhole end of the drill pipe (within the second wellbore) using the spring-loaded latch of the adapter.

In some implementations, the non-metallic tubular includes at least one of plastic, rubber, or ceramic.

Certain aspects of the subject matter described can be implemented as an apparatus. The apparatus includes a protective tubular, a non-metallic tubular, and an adapter. The protective tubular is configured to be run downhole into a subterranean formation. The protective tubular includes a downhole end that is configured to receive a latch at an inner circumference of the downhole end. The non-metallic tubular is disposed within the protective tubular. The non-metallic tubular has an outer diameter that is less than an inner diameter of the protective tubular. The adapter is at an uphole end of the non-metallic tubular. The adapter includes a shear pin and the latch. The shear pin is configured to hold a relative longitudinal position of the non-metallic tubular relative to the protective tubular while the shear pin is intact. The shear pin protrudes radially outward from the non-metallic tubular and is in contact with an inner circumferential wall of the protective tubular. The latch is a spring-loaded latch that is configured to couple the uphole end of the non-metallic tubular to the downhole end of the protective tubular in response to the uphole end of the non-metallic tubular meeting the downhole end of the protective tubular.

In some implementations, the adapter includes a ball seat and a ball catcher. In some implementations, the ball seat is at an uphole end of the adapter and is configured to receive a ball. In some implementations, the shear pin is configured to be sheared in response to the ball seat receiving the ball, thereby allowing the non-metallic tubular to move longitudinally relative to the protective tubular. In some implementations, the ball catcher is positioned at or near a downhole end of the adapter. In some implementations, the ball seat is configured to be sheared in response to the spring-loaded latch coupling the uphole end of the non-metallic tubular to the downhole end of the protective tubular, thereby allowing the ball to pass through the sheared ball seat and be received by the call catcher. In some implementations, the adapter defines an opening between the ball seat and the ball catcher for flowing fluid into the non-metallic tubular.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

This disclosure describes a dual tubular device that can be used to flow lost circulation treatment fluid into a wellbore. The inner tubular is non-metallic, and the outer tubular protects the inner tubular as the device is run into the hole to the desired location. In some cases, quick-setting lost circulation treatment fluids are needed to remedy lost circulation in a well. Such cases carry risk of flash setting of the treatment fluid, which can result in a string getting stuck in the wellbore. The inner tubular can be easily drilled out if necessary. In some implementations, the inner tubular can be purposely broken and left in the wellbore as a sacrificial tubular that is later drilled out with cement utilizing normal clean out or drilling operations that do not incur additional time or costs. In some implementations, after the lost circulation treatment fluid has been flowed into the wellbore, the inner tubular can be retrieved back into the outer tubular, transported to another location (for example, to a different well), and be reused.

Figure 1:
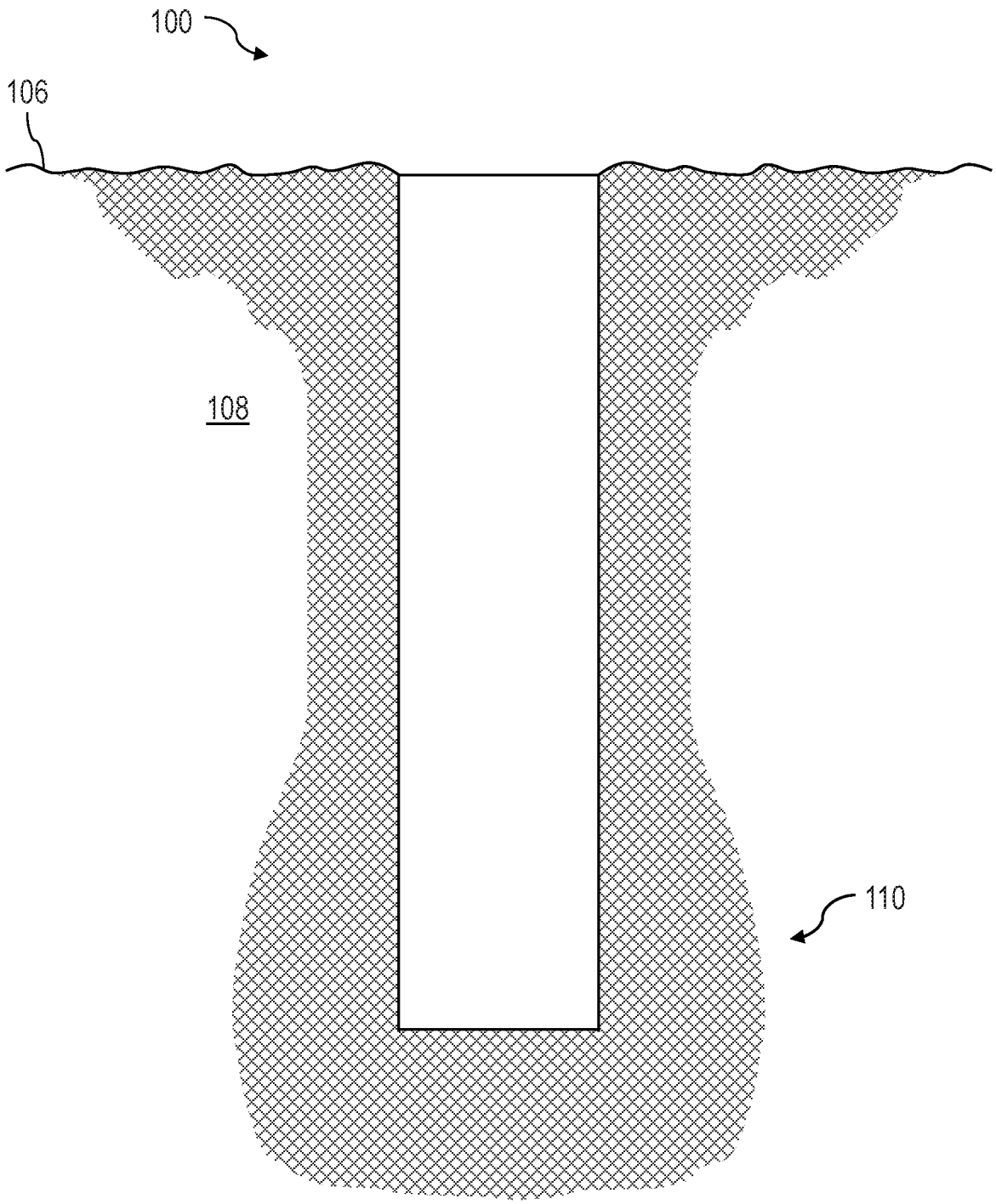
FIG. 1 is a schematic diagram of an example well.

FIG. 1 depicts an example well 100 constructed in accordance with the concepts herein. The well 100 extends from the surface 106 through the Earth 108 to one more subterranean zones of interest 110 (one shown). The well 100 enables access to the subterranean zones of interest 110 to allow recovery (that is, production) of fluids to the surface 106 (represented by flow arrows in FIG. 1) and, in some implementations, additionally or alternatively allows fluids to be placed in the Earth 108. In some implementations, the subterranean zone 110 is a formation within the Earth 108 defining a reservoir, but in other instances, the zone 110 can be multiple formations or a portion of a formation. The subterranean zone can include, for example, a formation, a portion of a formation, or multiple formations in a hydrocarbon-bearing reservoir from which recovery operations can be practiced to recover trapped hydrocarbons. In some implementations, the subterranean zone includes an underground formation of naturally fractured or porous rock containing hydrocarbons (for example, oil, gas, or both). In some implementations, the well can intersect other suitable types of formations, including reservoirs that are not naturally fractured. For simplicity's sake, the well 100 is shown as a vertical well, but in other instances, the well 100 can be a deviated well with a wellbore deviated from vertical (for example, horizontal or slanted), the well 100 can include multiple bores forming a multilateral well (that is, a well having multiple lateral wells branching off another well or wells), or both.

In some implementations, the well 100 is a gas well that is used in producing hydrocarbon gas (such as natural gas) from the subterranean zones of interest 110 to the surface 106. While termed a "gas well," the well need not produce only dry gas, and may incidentally or in much smaller quantities, produce liquid including oil, water, or both. In some implementations, the well 100 is an oil well that is used in producing hydrocarbon liquid (such as crude oil) from the subterranean zones of interest 110 to the surface 106. While termed an "oil well," the well not need produce only hydrocarbon liquid, and may incidentally or in much smaller quantities, produce gas, water, or both. In some implementations, the production from the well 100 can be multiphase in any ratio. In some implementations, the production from the well 100 can produce mostly or entirely liquid at certain times and mostly or entirely gas at other times. For example, in certain types of wells it is common to produce water for a period of time to gain access to the gas in the subterranean zone. The concepts herein, though, are not limited in applicability to gas wells, oil wells, or even production wells, and could be used in wells for producing other gas or liquid resources or could be used in injection wells, disposal wells, or other types of wells used in placing fluids into the Earth. The wellbore of the well 100 is typically, although not necessarily, cylindrical.

Figure 2A:
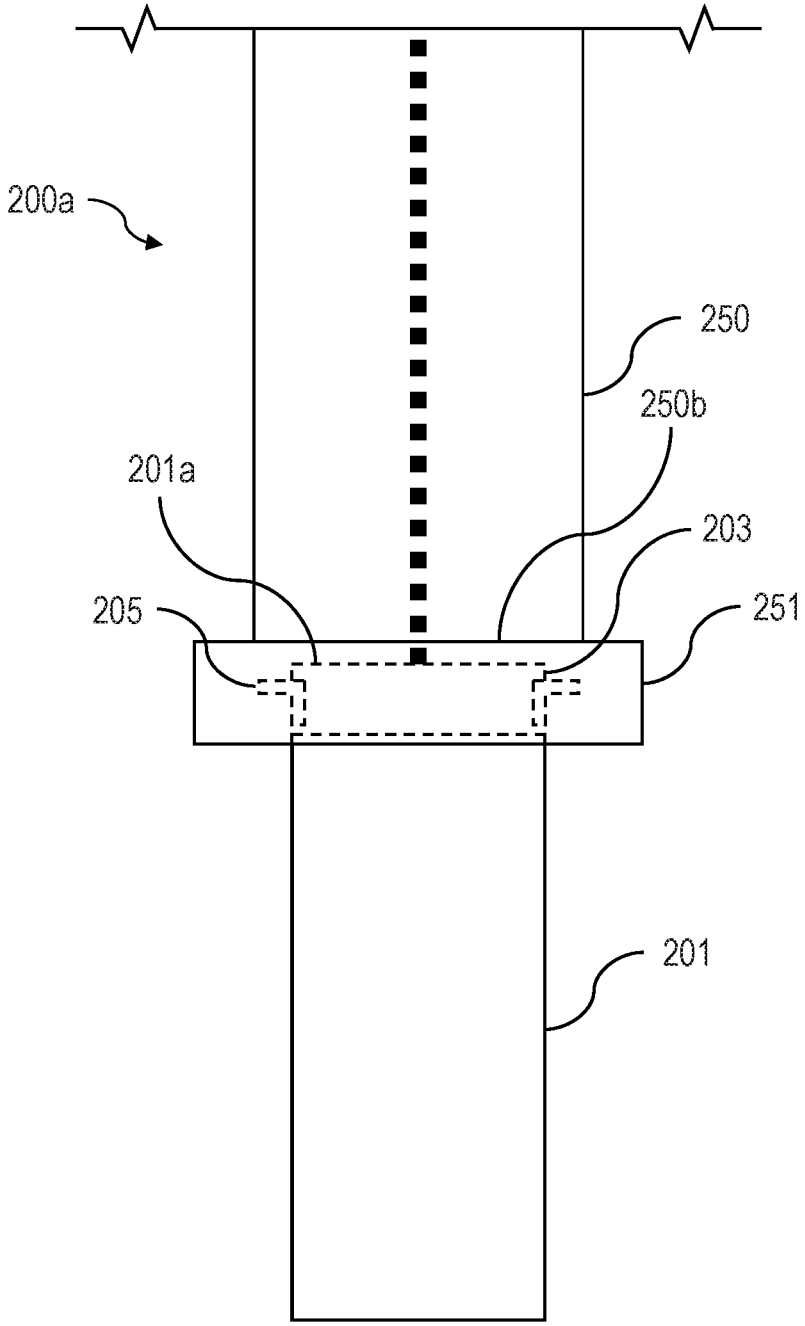
FIG. 2A is a schematic diagram of an example apparatus that can be implemented in the well of FIG. 1.

FIG. 2A is a schematic diagram of an implementation of the apparatus 200*a* that can be implemented in the well 100. The apparatus 200*a* includes a non-metallic tubular 201 and an adapter 203. The non-metallic tubular 201 is configured to be disposed within a protective tubular 250 while the non-metallic tubular 201 is run downhole to a subterranean zone (for example, the zone 110). The adapter 203 is located at an uphole end 201*a* of the non-metallic tubular 201. In the implementation shown in FIG. 2A, the protective tubular 250 is a drill pipe. In some implementations, the drill pipe is run downhole with the non-metallic tubular 201 disposed within the drill pipe. The protective tubular 250 includes a downhole end 250*b* that is configured to receive a latch (for example, the spring-loaded latch 205 described in more detail later) at an inner circumference of the downhole end 250*b*.

The construction of the protective tubular 250 is configured to withstand the impacts, scraping, and other physical challenges the apparatus 200*a* will encounter while being passed hundreds of feet/meters or even multiple miles/kilometers into and out of the well 100. For example, the apparatus 200*a* can be disposed in the well 100 at a depth of up to 20,000 feet (6,096 meters). Beyond just a rugged exterior, this encompasses having certain portions of any electronics being ruggedized to be shock resistant and remain fluid tight during such physical challenges and during operation. Additionally, the protective tubular 250 is configured to withstand and operate for extended periods of time (for example, multiple weeks, months or years) at the pressures and temperatures experienced in the well 100, which temperatures can exceed 400 degrees Fahrenheit (° F.)/205 degrees Celsius (° C.) and pressures over 2,000 pounds per square inch gauge (psig), and while submerged in the well fluids (gas, water, or oil as examples). In some implementations, the protective tubular 250 is made of metal, for example, stainless steel.

The apparatus 200*a* can operate in a variety of downhole conditions of the well 100. For example, the initial pressure within the well 100 can vary based on the type of well, depth of the well 100, and production flow from the perforations into the well 100. In some examples, the pressure in the well 100 proximate a bottomhole location is sub-atmospheric, where the pressure in the well 100 is at or below about 14.7 pounds per square inch absolute (psia), or about 101.3 kiloPascal (kPa). The apparatus 200*a* can operate in sub-atmospheric well pressures, for example, at well pressure between 2 psia (13.8 kPa) and 14.7 psia (101.3 kPa). In some examples, the pressure in the well 100 proximate a bottomhole location is much higher than atmospheric, where the pressure in the well 100 is above about 14.7 pounds per square inch absolute (psia), or about 101.3 kiloPascal (kPa). The apparatus 200*a* can operate in above atmospheric well pressures.

The non-metallic tubular 201 has an outer diameter that is less than an inner diameter of the protective tubular 250, such that the entire non-metallic tubular 201 can be disposed within the protective tubular 250. The non-metallic tubular 201 is made of a material that can be milled or drilled through without exerting more force than is typical for drilling through cement in a wellbore. In some implementations, the non-metallic tubular 201 is made of a non-metallic material, such as plastic, rubber, ceramic, or a combination of these. A lost circulation treatment fluid can be injected through the non-metallic tubular 201. In some implementations, the lost circulation treatment fluid includes bridging material, rapid-setting cement, thixotropic cement, lightweight cement, or a combination of these. In cases a flash-setting cement is used, and the non-metallic tubular 201 becomes stuck, the non-metallic tubular 201 can be more easily drilled in comparison to tubulars made of stronger material (such as metal). The non-metallic tubular 201 is protected by the protective tubular 250 while the non-metallic tubular 201 is run downhole. The protective tubular 250 prevents potential slack off on the non-metallic tubular 201 as it is being run downhole. Once the non-metallic tubular 201 reaches a desired location in the well 100 (for example, the zone 110), the non-metallic tubular 201 can be exposed from the protective tubular 250, and the lost circulation treatment fluid can be injected through the non-metallic tubular 201 to the zone 110 to remedy the lost circulation.

The adapter 203 includes a spring-loaded latch 205. The spring-loaded latch 205 includes a spring and a latch that protrudes radially outward with respect to the body of the adapter 203. The spring of the spring-loaded latch 205 biases the latch in a radially outward direction with respect to the body of the adapter 203. In some implementations, the spring-loaded latch 205 is configured to couple the uphole end 201*a* of the non-metallic tubular 201 to a downhole end 250*b* of the protective tubular 250 (drill pipe). By coupling the uphole end 201*a* of the non-metallic tubular 201 to the downhole end 250*b* of the protective tubular 250, the spring-loaded latch fixes the position of the non-metallic tubular relative to the protective tubular 250. In some implementations, the protective tubular 250 includes a hanging sub 251 at the downhole end 250*b* of the protective tubular 250. In such implementations, the spring-loaded latch 205 of the adapter 203 is configured to couple the uphole end 201*a* of the non-metallic tubular 201 to the hanging sub 251 of the protective tubular 250. In some implementations, the adapter 203 is configured to couple to a slick line, such that the non-metallic tubular 201 is configured to be run downhole to the subterranean zone 110 through the drill pipe by the slick line. In such implementations, the adapter 203 is configured to release the non-metallic tubular 201 from the slick line in response to over pull of the slick line in an uphole direction exceeding an over pull threshold of the adapter 203.

This paragraph provides an example of operation of the apparatus 200*a* in the well 100. The drill pipe (protective tubular 250) is run downhole into the well 100. The non-metallic tubular 201 is run downhole via slick line through the drill pipe (protective tubular 250). Because the non-metallic tubular 201 is run through the protective tubular 250, the non-metallic tubular 201 is protected as it is being run downhole. Once the non-metallic tubular 201 reaches the desired depth within the well 100 (for example, the zone 110), the non-metallic tubular 201 is exposed from the downhole end 250*b* of the protective tubular 250 (drill pipe). Once the uphole end 201*a* of the non-metallic tubular 201 reaches the downhole end 250*b* of the protective tubular 250 (drill pipe), the spring-loaded latch 205 of the adapter 203 couples the uphole end 201*a* of the non-metallic tubular 201 to the downhole end 250*b* of the protective tubular 250. Lost circulation treatment fluid is then injected through the non-metallic tubular 201 to the zone 110 to remedy the lost circulation. The apparatus 200*a* can then be pulled out of hole, and in some cases, be reused in another well. In cases where an aggressive cement or a rapid-setting cement is used as the lost circulation treatment fluid, after the lost circulation treatment fluid has been given enough time to change properties (for example, set), the non-metallic tubular 201 is drilled, and drilling operations can continue.

Figure 2B:
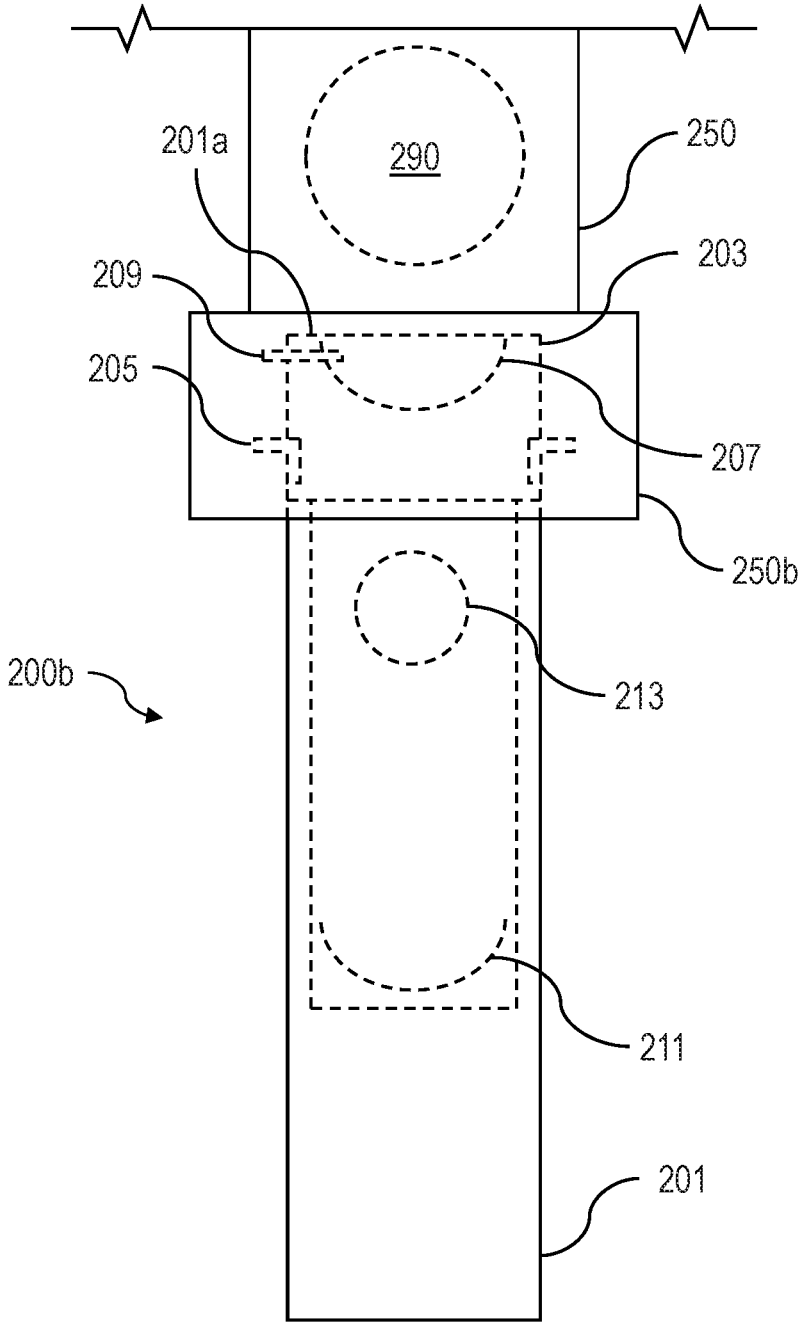
FIG. 2B is a schematic diagram of an example apparatus that can be implemented in the well of FIG. 1.

FIG. 2B is a schematic diagram of another implementation of the apparatus 200*b* that can be implemented in the well 100. The apparatus 200*b* shown in FIG. 2B includes similar features as the apparatus 200*a* shown in FIG. 2A. The apparatus 200*b* includes a protective tubular 250, a non-metallic tubular 201, and an adapter 203. The protective tubular 250 is configured to be run downhole into a subterranean formation (for example, into the well 100 to the zone 110). The non-metallic tubular 201 is disposed within the protective tubular 250. The adapter 203 is at an uphole end 201*a* of the non-metallic tubular 201.

The construction of the external components of the apparatus 200*b* (for example, the protective tubular 250) are configured to withstand the impacts, scraping, and other physical challenges the apparatus 200*b* will encounter while being passed hundreds of feet/meters or even multiple miles/kilometers into and out of the well 100. For example, the apparatus 200*b* can be disposed in the well 100 at a depth of up to 20,000 feet (6,096 meters). Beyond just a rugged exterior, this encompasses having certain portions of any electronics being ruggedized to be shock resistant and remain fluid tight during such physical challenges and during operation. Additionally, the protective tubular is configured to withstand and operate for extended periods of time (for example, multiple weeks, months or years) at the pressures and temperatures experienced in the well 100, which temperatures can exceed 400 degrees Fahrenheit (° F.)/205 degrees Celsius (° C.) and pressures over 2,000 pounds per square inch gauge (psig), and while submerged in the well fluids (gas, water, or oil as examples).

The apparatus 200*b* can operate in a variety of downhole conditions of the well 100. For example, the initial pressure within the well 100 can vary based on the type of well, depth of the well 100, and production flow from the perforations into the well 100. In some examples, the pressure in the well 100 proximate a bottomhole location is sub-atmospheric, where the pressure in the well 100 is at or below about 14.7 pounds per square inch absolute (psia), or about 101.3 kiloPascal (kPa). The apparatus 200*a* can operate in sub-atmospheric well pressures, for example, at well pressure between 2 psia (13.8 kPa) and 14.7 psia (101.3 kPa). In some examples, the pressure in the well 100 proximate a bottomhole location is much higher than atmospheric, where the pressure in the well 100 is above about 14.7 pounds per square inch absolute (psia), or about 101.3 kiloPascal (kPa). The apparatus 200*a* can operate in above atmospheric well pressures.

In some implementations, the protective tubular 250 can be configured to interface with one or more of the common deployment systems, such as jointed tubing (that is, lengths of tubing joined end-to-end), a sucker rod, coiled tubing (that is, not-jointed tubing, but rather a continuous, unbroken and flexible tubing formed as a single piece of material), or wireline with an electrical conductor (that is, a monofilament or multifilament wire rope with one or more electrical conductors, sometimes called e-line) and thus have a corresponding connector (for example, a jointed tubing connector, coiled tubing connector, or wireline connector). In some implementations, the protective tubular 250 interfaces with a downhole end of a drill pipe, and the drill pipe is run downhole into the well 100 to deploy the apparatus 200.

In some implementations, a portion of the adapter 203 resides in an inner volume of the non-metallic tubular 201. The adapter 203 and the non-metallic tubular 201 are fixed in position relative to each other. As such, the adapter 203 and the non-metallic tubular 201 do not move (radially or longitudinally) relative to one another.

The adapter 203 includes the spring-loaded latch 205. The spring-loaded latch 205 is configured to couple the uphole end 201*a* of the non-metallic tubular 201 to a downhole end 250*b* of the protective tubular 250 in response to the uphole end 201*a* of the non-metallic tubular 201 meeting the downhole end 250*b* of the protective tubular 250.

In some implementations, the adapter 203 includes a ball seat 207. The ball seat 207 is configured to receive a ball 290. The ball 290 can be flowed (for example, with a fluid) to the ball seat 207.

In some implementations, the adapter 203 includes a shear pin 209. The shear pin 209 is configured to hold a relative longitudinal position of the non-metallic tubular 201 relative to the protective tubular 250 while the shear pin 209 is intact. In some implementations, the shear pin 209 protrudes radially outward from the non-metallic tubular 201 and is in contact with an inner circumferential wall of the protective tubular 250 when the shear pin 209 is intact. For example, the shear pin 209 holds the relative longitudinal position of the non-metallic tubular 201 relative to the protective tubular 250 as the apparatus 200 is run downhole to the zone 110. In response to the ball seat 207 receiving the ball 290, the shear pin 209 is configured to be sheared (for example, broken), thereby allowing the non-metallic tubular 201 to move longitudinally relative to the protective tubular 250. When the shear pin 209 is broken, the shear pin 209 loses contact with the inner circumferential wall of the protective tubular 250, and the non-metallic tubular 201 is free to move longitudinally relative to the protective tubular 250. Once the uphole end 201*a* of the non-metallic tubular 201 meets the downhole end 250*b* of the protective tubular 250, the spring-loaded latch 205 couples the uphole end 201*a* of the non-metallic tubular 201 to the downhole end 250*b* of the protective tubular 250.

In some implementations, the adapter 203 includes a ball catcher 211 that is positioned at or near a downhole end of the adapter 203. In such implementations, the ball seat 207 is configured to be sheared in response to the spring-loaded latch 205 coupling the uphole end 201*a* of the non-metallic tubular 201 to the downhole end 250*b* of the protective tubular 250, thereby allowing the ball 290 to pass through the sheared ball seat 207 and be received by the ball catcher 211. In such implementations, the adapter 203 defines an opening 213 between the ball seat 207 and the ball catcher 211 through which fluid can flow into the non-metallic tubular 201. The fluid can then flow out of the non-metallic tubular 201 and into the zone 110.

This paragraph provides an example of operation of the apparatus 200*b* in the well 100. The non-metallic tubular 201 is disposed within the protective tubular 250. The protective tubular 250 is coupled to a downhole end of a drill pipe. The drill pipe (with the protective tubular 250 and non-metallic tubular 201) is run downhole into the well 100. Because the non-metallic tubular 201 is disposed within the protective tubular 250, the non-metallic tubular 201 is protected as it is being run downhole. Once the non-metallic tubular 201 reaches the desired depth within the well 100 (for example, the zone 110), the ball 290 is flowed (for example, with a fluid) to the ball seat 207. The ball 290 received by the ball seat 207 shears the shear pin 209, which frees the non-metallic tubular 201 to move longitudinally relative to the protective tubular 250. The non-metallic tubular 201 is exposed from the downhole end 250*b* of the protective tubular 250. Once the uphole end 201*a* of the non-metallic tubular 201 reaches the downhole end 250*b* of the protective tubular 250, the spring-loaded latch 205 of the adapter 203 couples the uphole end 201*a* of the non-metallic tubular 201 to the downhole end 250*b* of the protective tubular 250. Once the spring-loaded latch 205 couples the uphole end 201*a* of the non-metallic tubular 201 to the downhole end 250*b* of the protective tubular 250, the ball 290 shears the ball seat 207 and passes through the ball seat 207 to be received by the ball catcher 211. The ball 290 shearing and passing through the ball seat 207 exposes the opening 213 which allows for fluid communication between upstream of the apparatus 200*b* and the inner volume of the non-metallic tubular 201. Lost circulation treatment fluid is then injected through the non-metallic tubular 201 to the zone 110 to remedy the lost circulation. The apparatus 200*b* can then be pulled out of hole, and in some cases, be reused in another well. In cases where an aggressive cement or a rapid-setting cement is used as the lost circulation treatment fluid, after the lost circulation treatment fluid has been given enough time to change properties (for example, set), the non-metallic tubular 201 is drilled, and drilling operations can continue.

Figure 3A:
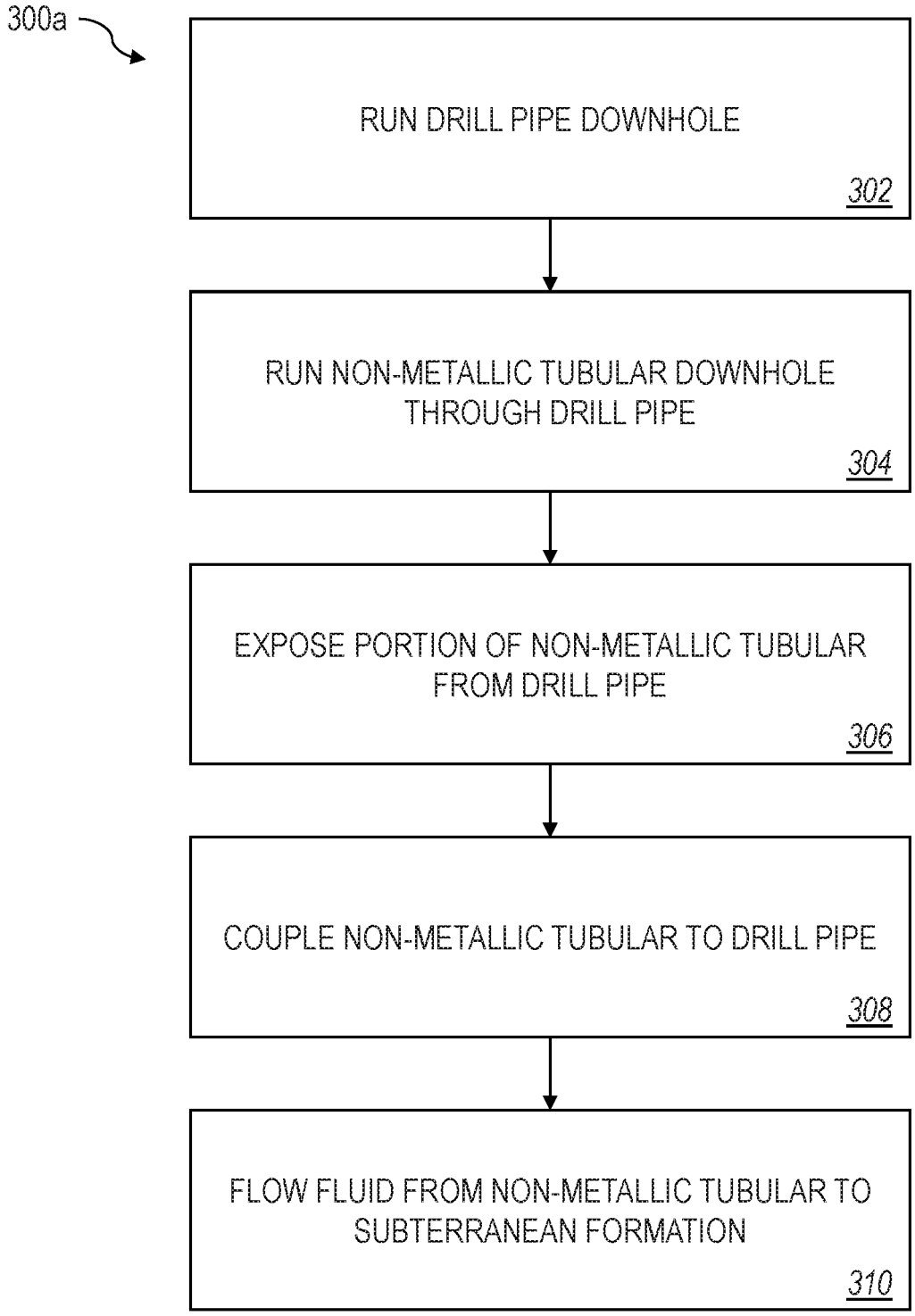
FIG. 3A is a flow chart of an example method that can be implemented by the apparatus of FIG. 2A.

FIG. 3A is a flow chart of an example method 300*a* that can be implemented, for example, by the apparatus 200*a*. At step 302, a drill pipe is run downhole into a wellbore in a subterranean formation (for example, the wellbore of the well 100).

At step 304, a non-metallic tubular (for example, the non-metallic tubular 201) is run through the drill pipe. As described previously, the non-metallic tubular 201 includes an adapter 203 at an uphole end 201*a* of the non-metallic tubular 201, and the adapter 203 includes a spring-loaded latch 205. The adapter 203 can be coupled to a slick line, and the slick line can be used to run the non-metallic tubular 201 through the drill pipe at step 304.

At step 306, at least a portion of the non-metallic tubular 201 is exposed from a downhole end of the drill pipe.

At step 308, the uphole end 201*a* of the non-metallic tubular 201 is coupled to the downhole end of the drill pipe using the spring-loaded latch 205 of the adapter 203. In some implementations, the downhole end of the drill pipe can include a hanging sub. In such implementations, coupling the uphole end 201*a* of the non-metallic tubular 201 to the downhole end of the drill pipe at step 308 includes coupling the uphole end 201*a* of the non-metallic tubular 201 to the hanging sub of the drill pipe using the spring-loaded latch 205 of the adapter 203.

At step 310, a fluid is flowed from within the non-metallic tubular 201 to the subterranean formation through an opening defined by the non-metallic tubular 201. In some implementations, the slick line is over pulled to release the slick line from the adapter 203 before flowing the fluid at step 310. In some implementations, the fluid flowed at step 310 is a lost circulation treatment fluid that includes bridging material, rapid-setting cement, thixotropic cement, lightweight cement, or a combination of these.

In some implementations, the fluid is allowed to set within the wellbore. In some implementations, the non-metallic tubular 201 is drilled after the fluid has set.

Figure 3B:
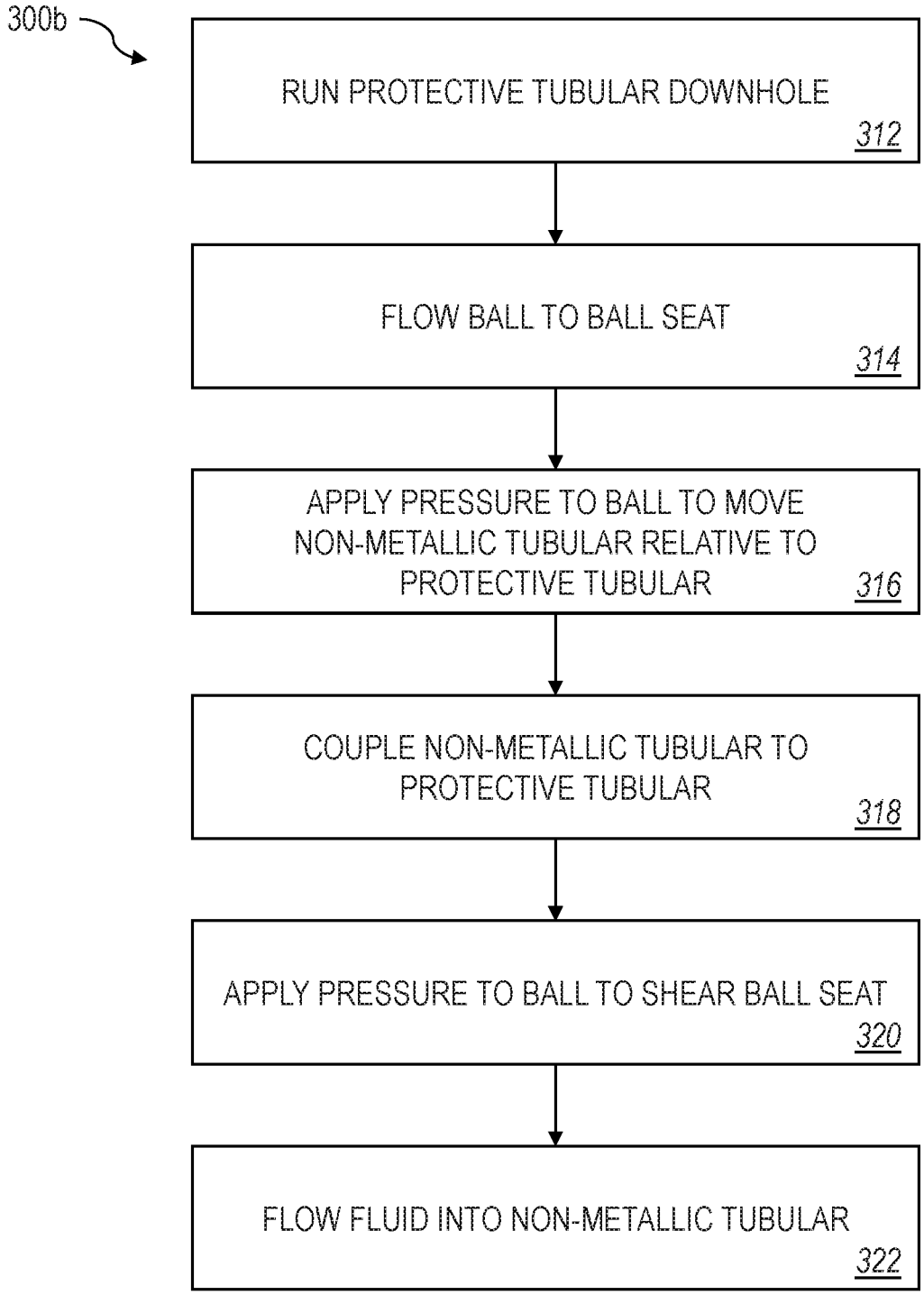
FIG. 3B is a flow chart of an example method that can be implemented by the apparatus of FIG. 2B.

FIG. 3B is a flow chart of an example method 300*b* that can be implemented, for example, by the apparatus 200*b*. At step 312, a protective tubular (for example, the protective tubular 250) is run downhole into a wellbore in a subterranean formation (for example, the wellbore of the well 100). In some implementations, running the protective tubular 250 into the wellbore at step 312 includes running a drill pipe downhole into the wellbore with the protective tubular 250 disposed at a downhole end of the drill pipe.

A non-metallic tubular (for example, the non-metallic tubular 201) is disposed within the protective tubular 250 during step 312. As described previously, the non-metallic tubular 201 includes an adapter 203 at an uphole end 201*a* of the non-metallic tubular 201. The adapter 203 includes a spring-loaded latch 205, a ball seat 207, a shear pin 209, and a ball catcher 211. The shear pin 209 holds a longitudinal position of the non-metallic tubular 201 relative to the protective tubular 250 while the shear pin 209 is intact.

At step 314, a ball (for example, the ball 290) is flowed to the ball seat 207 of the adapter 203, thereby shearing the shear pin 209 of the adapter 203. Shearing the shear pin 209 allows the non-metallic tubular 201 to move longitudinally relative to the protective tubular 250.

At step 316, pressure is applied to the ball 290 to move the non-metallic tubular 201 longitudinally relative to the protective tubular 250 until an uphole end 201*a* of the non-metallic tubular 201 meets a downhole end 250*b* of the protective tubular 250.

At step 318, the uphole end 201*a* of the non-metallic tubular 201 is coupled to the downhole end 250*b* of the protective tubular 250 using the spring-loaded latch 205 of the adapter 203.

At step 320, pressure is applied to the ball 290 to shear the ball seat 207 of the adapter 203, thereby allowing the ball 290 to pass through the sheared ball seat 207 and be received by the ball catcher 211 of the adapter 203.

At step 322, a fluid is flowed into the non-metallic tubular 201 through an opening defined by the adapter 203 between the ball seat 207 and the ball catcher 211 (for example, the opening 213). In some implementations, the fluid flowed at step 322 is a lost circulation treatment fluid that includes bridging material, rapid-setting cement, thixotropic cement, lightweight cement, or a combination of these.

In some implementations, the fluid is allowed to set within the wellbore. In some implementations, the non-metallic tubular 201 is drilled after the fluid has set.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

As used in this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

As used in this disclosure, the term "about" or "approximately" can allow for a degree of variability in a value or range, for example, within 10%, within 5%, or within 1% of a stated value or of a stated limit of a range.

As used in this disclosure, the term "substantially" refers to a majority of, or mostly, as in at least about 50%, 60%, 70%, 80%, 90%, 95%, 96%, 97%, 98%, 99%, 99.5%, 99.9%, 99.99%, or at least about 99.999% or more.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described components and systems can generally be integrated together or packaged into multiple products.

Accordingly, the previously described example implementations do not define or constrain the present disclosure. Other changes, substitutions, and alterations are also possible without departing from the spirit and scope of the present disclosure.

What is claimed is:

1. A method comprising:

running a protective tubular downhole into a wellbore in a subterranean formation, a non-metallic tubular disposed within the protective tubular and comprising an adapter at an uphole end of the non-metallic tubular, the adapter comprising:

a spring-loaded latch;

a ball seat;

a shear pin holding a longitudinal position of the non-metallic tubular relative to the protective tubular while the shear pin is intact; and a ball catcher;

flowing a ball to the ball seat of the adapter, thereby shearing the shear pin of the adapter and allowing the non-metallic tubular to move longitudinally relative to the protective tubular;

applying pressure to the ball to move the non-metallic tubular longitudinally relative to the protective tubular until an uphole end of the non-metallic tubular meets a downhole end of the protective tubular;

coupling the uphole end of the non-metallic tubular to the downhole end of the protective tubular using the spring-loaded latch of the adapter;

applying pressure to the ball to shear the ball seat of the adapter, thereby allowing the ball to pass through the sheared ball seat and be received by the ball catcher of the adapter; and flowing a fluid into the non-metallic tubular through an opening defined by the adapter between the ball seat and the ball catcher.

2. The method of claim 1, wherein running the protective tubular downhole into the wellbore comprises running a drill pipe downhole into the wellbore with the protective tubular disposed at a downhole end of the drill pipe.

3. The method of claim 2, wherein the non-metallic tubular comprises at least one of plastic, rubber, or ceramic, and the protective tubular comprises a metal.

4. The method of claim 2, wherein the fluid is a lost circulation treatment fluid comprising bridging material, rapid-setting cement, thixotropic cement, lightweight cement, or a combination thereof.

5. The method of claim 4, comprising allowing the fluid to set within the wellbore and drilling the non-metallic tubular after the fluid has set.

6. The method of claim 4, comprising:

retrieving the protective tubular and the non-metallic tubular from the wellbore;

disposing the non-metallic tubular within the protective tubular; and running the protective tubular downhole into a second wellbore.

7. The method of claim 1, wherein the protective tubular is coupled to jointed tubing, a sucker rod, coiled tubing, or wireline.

8. The method of claim 1, wherein a portion of the adapter resides in an inner volume of the non-metallic tubular.

9. The method of claim 1, wherein the adapter and the non-metallic tubular are fixed in position relative to each other.

10. The method of claim 1, wherein flowing the ball to the ball seat of the adapter comprises flowing the ball with a fluid.

11. The method of claim 1, wherein the shear pin holds the longitudinal position of the non-metallic tubular relative to the protective tubular as the protective tubular is run downhole.

12. The method of claim 1, comprising flowing fluid out of the non-metallic tubular and into the subterranean zone.

13. The method of claim 12, wherein the fluid is a lost circulation treatment fluid comprising bridging material, rapid-setting cement, thixotropic cement, lightweight cement, or a combination thereof.

* * * * *